US011212880B2

(12) United States Patent
Altamura et al.

(10) Patent No.: US 11,212,880 B2
(45) Date of Patent: Dec. 28, 2021

(54) INDUCTION COOKING TOP

(71) Applicant: WHIRLPOOL EMEA S.P.A., Pero (IT)

(72) Inventors: Davide Altamura, Fabriano (IT); Diego Bariviera, Fabriano (IT); Alessio Beato, Fabriano (IT)

(73) Assignee: Whirlpool EMEA S.p.A., Pero (IT)

( * ) Notice: Subject to any disclaimer, the term of this patent is extended or adjusted under 35 U.S.C. 154(b) by 538 days.

(21) Appl. No.: 14/435,814

(22) PCT Filed: Oct. 14, 2013

(86) PCT No.: PCT/IB2013/059340

§ 371 (c)(1),
(2) Date: Apr. 15, 2015

(87) PCT Pub. No.: WO2014/060928

PCT Pub. Date: Apr. 24, 2014

(65) Prior Publication Data

US 2015/0296570 A1 Oct. 15, 2015

(30) Foreign Application Priority Data

Oct. 15, 2012 (IT) ..... TO2012A000896

(51) Int. Cl.
*H05B 6/06* (2006.01)
*H05B 6/12* (2006.01)

(52) U.S. Cl.
CPC ..... *H05B 6/065* (2013.01); *H05B 6/062* (2013.01); *H05B 6/12* (2013.01); *H05B 2213/05* (2013.01)

(58) Field of Classification Search
CPC ..... H05B 6/062; H05B 6/065; H05B 6/12; H05B 2213/05
USPC ..... 219/626, 665
See application file for complete search history.

(56) References Cited

U.S. PATENT DOCUMENTS 3,259,837 A 7/1966 Oshry
3,814,888 A 6/1974 Bowers et al.
4,016,392 A * 4/1977 Kobayashi ..... H05B 3/683 219/626
4,029,926 A 6/1977 Austin
4,220,839 A 9/1980 De Leon
4,356,371 A * 10/1982 Kiuchi ..... H05B 6/062 219/626
4,415,788 A 11/1983 Field
(Continued)

FOREIGN PATENT DOCUMENTS

CN 102396294 A 3/2012
CN 103596307 A 2/2014
(Continued)

OTHER PUBLICATIONS

European Search Report dated Sep. 21, 2016 for Application No. PCT/IB2013/059340, entitled "Induction Cooking Top", filed Oct. 14, 2013; 5 pages.
(Continued)

*Primary Examiner* — John J Norton
(74) *Attorney, Agent, or Firm* — Price Heneveld LLP

(57) ABSTRACT

The present disclosure relates to an induction cooking top comprising a system adapted to modify the control of the presence of the pan on the induction cooking top, upon a command by the user.

10 Claims, 1 Drawing Sheet

(56) References Cited

U.S. PATENT DOCUMENTS 4,431,892 A 2/1984 White
4,438,311 A 3/1984 Tazima et al.
4,464,553 A * 8/1984 Ikeda ..... H05B 6/062 219/489
4,476,946 A 10/1984 Smith
4,540,866 A * 9/1985 Okuda ..... H05B 6/062 219/626
4,629,843 A 12/1986 Kato et al.
4,695,770 A 9/1987 Raets
4,713,528 A * 12/1987 Hirata ..... H05B 6/062 219/492
4,776,980 A 10/1988 Ruffini
4,810,847 A * 3/1989 Ito ..... H05B 6/062 219/626
4,820,891 A 4/1989 Tanaka et al.
5,190,026 A 3/1993 Doty
5,523,631 A 6/1996 Fishman et al.
5,571,438 A 11/1996 Izaki et al.
5,640,497 A 6/1997 Woolbright
5,665,263 A 9/1997 Gaspard
5,686,006 A 11/1997 Gaspard
5,808,280 A 9/1998 Gaspard
5,866,884 A 2/1999 Cornec et al.
6,018,154 A 1/2000 Izaki et al.
6,078,033 A 6/2000 Bowers et al.
6,184,501 B1 * 2/2001 Zapf ..... H05B 3/746 219/447.1
6,230,137 B1 5/2001 Has et al.
6,693,262 B2 2/2004 Gerola et al.
6,696,770 B2 2/2004 Nadot et al.
6,764,277 B2 7/2004 Somahara et al.
7,021,895 B2 4/2006 Rubenstein et al.
7,023,246 B2 4/2006 Scollo et al.
7,049,563 B2 5/2006 Keishima et al.
7,053,678 B2 5/2006 Scollo et al.
7,057,144 B2 6/2006 Hirota et al.
7,274,008 B2 9/2007 Arnal Valero et al.
7,306,429 B2 12/2007 Horng et al.
7,390,994 B2 6/2008 Oh et al.
7,429,021 B2 9/2008 Sather et al.
7,504,607 B2 3/2009 Barragan Perez et al.
7,709,732 B2 5/2010 Phillips
7,759,616 B2 7/2010 Gouardo et al.
7,777,163 B2 8/2010 Hosoi et al.
7,786,414 B2 8/2010 Schilling et al.
7,910,865 B2 3/2011 Haag et al.
7,982,570 B2 7/2011 Burdick, Jr. et al.
8,017,864 B2 9/2011 Phillips
8,248,145 B2 8/2012 Melanson
8,263,916 B2 9/2012 Fujita et al.
8,350,194 B2 1/2013 Lee et al.
8,356,367 B2 1/2013 Flynn
8,431,875 B2 4/2013 Gutierrez
8,440,944 B2 5/2013 Acero Acero et al.
8,558,148 B2 10/2013 Artigas Maestre et al.
8,618,778 B2 12/2013 Gray et al.
8,658,950 B2 2/2014 Cho et al.
8,723,089 B2 5/2014 Sadakata et al.
8,742,299 B2 6/2014 Gouardo et al.
8,754,351 B2 6/2014 England et al.
8,791,398 B2 7/2014 De la Cuerda Ortin et al.
8,817,506 B2 8/2014 Shimomugi et al.
8,853,991 B2 10/2014 Shan et al.
8,878,108 B2 11/2014 Kitaizumi et al.
8,901,466 B2 12/2014 Schilling et al.
8,912,473 B2 12/2014 Roux
8,975,931 B2 3/2015 Koehler
9,006,621 B2 4/2015 Artal Lahoz et al.
9,060,389 B2 6/2015 Lee et al.
9,084,295 B2 7/2015 Sadakata et al.
9,113,502 B2 8/2015 Falcon et al.
9,198,233 B2 11/2015 Brosnan et al.
9,269,133 B2 2/2016 Cho et al.
9,277,598 B2 3/2016 Lee et al.
9,282,593 B2 3/2016 Brosnan et al.
9,326,329 B2 4/2016 Kitaizumi et al.
9,347,672 B2 5/2016 Jungbauer et al.
9,356,383 B2 5/2016 Waffenschmidt et al.
9,370,051 B2 6/2016 Fossati et al.
9,374,851 B2 6/2016 Klein et al.
9,400,115 B2 7/2016 Kuwamura
9,491,809 B2 11/2016 Shaffer et al.
9,554,425 B2 1/2017 Sawada et al.
9,603,202 B2 3/2017 Shaw
9,609,697 B2 3/2017 Aldana Arjol et al.
9,622,296 B2 4/2017 Dehnert et al.
2003/0004647 A1 1/2003 Sinclair
2003/0163326 A1 8/2003 Maase
2005/0002784 A1 1/2005 Li et al.
2006/0289489 A1 12/2006 Wang
2007/0246458 A1 10/2007 Seok et al.
2009/0020526 A1 1/2009 Roux
2009/0084777 A1 4/2009 Oh et al.
2009/0321424 A1 * 12/2009 Bunuel Magdalena ..... H05B 6/062 219/620
2010/0044367 A1 2/2010 Kim et al.
2010/0163546 A1 7/2010 Nanno et al.
2010/0182136 A1 7/2010 Pryor
2011/0084058 A1 4/2011 Kim et al.
2011/0155200 A1 6/2011 Simka
2011/0240632 A1 10/2011 Falcon et al.
2011/0272397 A1 11/2011 Lahoz et al.
2011/0303653 A1 12/2011 Chun et al.
2012/0024835 A1 2/2012 Artal Lahoz et al.
2012/0024842 A1 2/2012 Thomann et al.
2012/0223070 A1 9/2012 Matsui et al.
2012/0248098 A1 10/2012 Lee et al.
2012/0261405 A1 10/2012 Kurose et al.
2012/0321762 A1 12/2012 Aranda Vazquez et al.
2013/0334210 A1 12/2013 Takehira et al.
2014/0305928 A1 10/2014 Thompson et al.
2015/0245417 A1 8/2015 Fattorini et al.
2015/0341990 A1 11/2015 Nagata et al.
2016/0037584 A1 2/2016 Viroli et al.
2016/0037589 A1 2/2016 Altamura et al.
2016/0135255 A1 5/2016 Ogawa et al.
2016/0234889 A1 8/2016 Vazquez et al.
2016/0330799 A1 11/2016 Leyh et al.
2016/0381735 A1 12/2016 Christiansen et al.
2016/0381736 A1 12/2016 Christiansen et al.
2017/0055318 A1 2/2017 Franco Gutierrez et al.
2017/0105251 A1 4/2017 Viroli et al.
2017/0142783 A1 5/2017 Herzog et al.
2017/0181229 A1 6/2017 Lomp et al.

FOREIGN PATENT DOCUMENTS

DE 7242625 U 3/1973
DE 3909125 A1 9/1990
DE 4228076 C1 8/1993
DE 19907596 A1 8/2000
DE 102004009606 A1 9/2005
DE 102007032757 A1 2/2008
DE 102007037881 A1 1/2009
DE 202009000990 U1 4/2009
DE 102010028549 A1 11/2010
DE 112008002807 B4 9/2013
DE 102013206340 A1 10/2014
DE 102014105161 A1 10/2015
DE 102015220788 A1 6/2016
DE 102015220795 A1 6/2016
EP 0498735 A1 8/1992
EP 0722261 A1 12/1995
EP 0713350 A1 5/1996
EP 1137324 A1 9/2001
EP 1629698 B1 5/2003
EP 1505350 A2 2/2005
EP 1610590 A1 12/2005
EP 0926926 B1 11/2006
EP 1455453 B1 9/2007
EP 2095686 B1 11/2007
EP 2352359 B1 1/2009

(56) References Cited

FOREIGN PATENT DOCUMENTS

| | | | |
|---|---|---|---|
| EP | 2252130 | B1 | 3/2009 |
| EP | 2070442 | A2 | 6/2009 |
| EP | 1575336 | B1 | 1/2010 |
| EP | 2642820 | A1 | 11/2010 |
| EP | 2120508 | B1 | 12/2010 |
| EP | 2506662 | A1 | 3/2012 |
| EP | 2506674 | A1 | 3/2012 |
| EP | 2506662 | A1 | 10/2012 |
| EP | 2506674 | A1 | 10/2012 |
| EP | 2615376 | A1 | 7/2013 |
| EP | 2048914 | B1 | 10/2013 |
| EP | 2744299 | A1 | 6/2014 |
| EP | 2775785 | A1 | 9/2014 |
| EP | 2211591 | B2 | 10/2014 |
| EP | 1931177 | B1 | 5/2015 |
| EP | 2034799 | B1 | 5/2015 |
| EP | 2034800 | B1 | 5/2015 |
| EP | 2204072 | B1 | 7/2015 |
| EP | 2731402 | B1 | 8/2015 |
| EP | 2975289 | A2 | 1/2016 |
| EP | 1303168 | B1 | 3/2016 |
| EP | 2445309 | B1 | 5/2016 |
| EP | 2525485 | B1 | 7/2016 |
| EP | 2543232 | B1 | 7/2016 |
| EP | 2838316 | B1 | 10/2016 |
| EP | 2427032 | B1 | 12/2016 |
| EP | 2914059 | B1 | 12/2016 |
| EP | 3170363 | A1 | 5/2017 |
| EP | 3042541 | B1 | 6/2017 |
| EP | 2416621 | B1 | 7/2017 |
| EP | 3030042 | B1 | 8/2017 |
| EP | 3139702 | A1 | 8/2017 |
| EP | 3079443 | B1 | 11/2017 |
| ES | 2201937 | A1 | 3/2004 |
| ES | 2310962 | A1 | 1/2009 |
| ES | 2328540 | B1 | 9/2010 |
| ES | 2340900 | B1 | 5/2011 |
| ES | 2362523 | B1 | 8/2012 |
| FR | 2659725 | A1 | 9/1991 |
| FR | 2712071 | A1 | 5/1995 |
| FR | 2863039 | A1 | 6/2005 |
| FR | 2965446 | A1 | 3/2012 |
| GB | 2048025 | B | 1/1983 |
| JP | H07211443 | A | 8/1995 |
| JP | H07211444 | A | 8/1995 |
| JP | H08187168 | A | 7/1996 |
| JP | 2001196156 | A | 7/2001 |
| JP | 3225240 | B2 | 11/2001 |
| JP | 2008153046 | A | 7/2008 |
| JP | 2009117378 | A | 5/2009 |
| JP | 2009158225 | A | 7/2009 |
| JP | 4932548 | B2 | 5/2012 |
| KR | 20170019888 | A | 2/2017 |
| WO | 9737515 | A1 | 10/1997 |
| WO | 2005069688 | A2 | 7/2005 |
| WO | 2008031714 | A1 | 3/2008 |
| WO | 2008122495 | A1 | 10/2008 |
| WO | 2009016124 | A1 | 2/2009 |
| WO | 2009049989 | A1 | 4/2009 |
| WO | 2009053279 | A1 | 4/2009 |
| WO | 2010101135 | A1 | 9/2010 |
| WO | 2011128799 | A1 | 10/2011 |
| WO | 2011148289 | A2 | 12/2011 |
| WO | 2012104327 | A1 | 8/2012 |
| WO | 2014156010 | A1 | 10/2014 |
| WO | 2016010492 | A1 | 1/2016 |
| WO | 2016015971 | A1 | 2/2016 |
| WO | 2016071803 | A1 | 5/2016 |
| WO | 2016087297 | A1 | 6/2016 |
| WO | 2016134779 | A1 | 9/2016 |
| WO | 2017109609 | A1 | 6/2017 |
| WO | 2017115334 | A1 | 7/2017 |

OTHER PUBLICATIONS

International Patent Application No. PCT/IB2013059340 filed Oct. 14, 2013, Applicant: Indesit Company S.P.A., International Publication No. WO2014060928A2 published Apr. 24, 2014.

International Patent Application No. PCT/IB2013059340 filed Oct. 14, 2013, Applicant: Indesit Company S.P.A., Written Opinion of the International Searching Authority, dated Mar. 13, 2014 re: same.

Sarnago et al., "Multiple-Output ZCS Resonant Inverter for Multi-Coil Induction Heating Appliances," IEEE 2017, pp. 2234-2238.

Sarnago et al., "Modulation Scheme for Improved Operation of an RB-IGBT-Based Resonant Inverter Applied to Domestic Induction Heating," IEEE Transactions on Industrial Electronics, vol. 60, No. 5, May 2013, pp. 2066-2073.

* cited by examiner

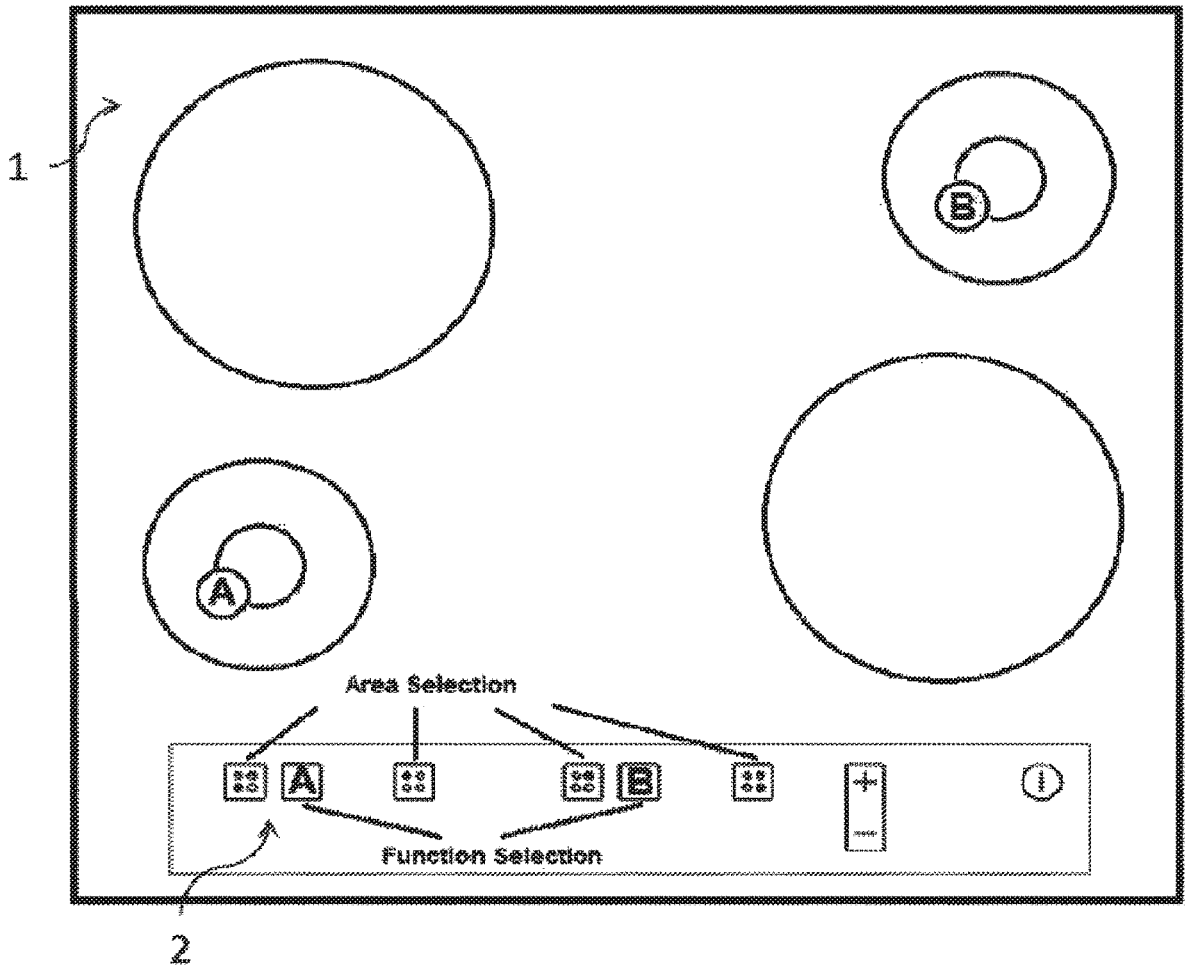
1
B
A
Area Selection
A
B
+
−
Function Selection
2

INDUCTION COOKING TOP

CROSS-REFERENCE TO RELATED APPLICATIONS

The present application represents a National Phase entry of International Application No. PCT/IB2013/059340 filed Oct. 14, 2013, which claims priority to Italian Application No. TO2012A000896 filed Oct. 15, 2012.

FIELD OF THE INVENTION

The present disclosure relates to an induction cooking top.

STATE OF THE ART

Induction cooking tops are devices which exploit the phenomenon of induction heating for food cooking purposes. Induction cooking tops comprise a top made of glass-ceramic material upon which cooking units are positioned (hereinafter "pans"). Moreover there are provided inductors comprising coils of copper wire where an oscillating current (e.g. an alternating current) is circulated producing an oscillating electromagnetic field. The electromagnetic field has the main effect of inducing a parasitic current inside the pan, which is made of an electrically conductive ferromagnetic material. The parasitic current circulating in the pan produces heat by dissipation; such heat is generated only within the pan and it acts without heating the cooking top.

This type of flameless cooking top has a better efficiency than electric cooking tops (i.e. a greater fraction of the absorbed electric power is converted into heat that heats the pan). In addition induction cooking tops are safer to use due to the absence of hot surfaces or flames, reducing the risk of burns for the user or of fire.

The presence of the pan on the cooking top causes the magnetic flux to close on the pan itself causing the power to be transferred towards the pan. The greater the size of the pan, the higher the power that can be transferred.

Since heat is generated by induced currents, the cooking top control system monitors the currents flowing through the coils; in this way, the power supplied to each inductor can be adjusted automatically. Moreover such current monitoring allows to automatically detect the presence of a pan over the inductors and to automatically turn them off in the absence of the pan on the cooking top.

A drawback arising from such controls, is that it is possible for small pans not to be detected and therefore such condition, corresponding to the absence of the pan, does not lead to cooking, since the cooking top control system does not activate the inductors, that is it does not activate the passage of the current through the coils of the inductors.

SUMMARY OF THE INVENTION

The object of the present disclosure may be to provide an induction cooking top capable of solving the drawbacks of the prior art.

A further object of the present disclosure may be to provide an induction cooking top which may be simpler and cheaper to manufacture.

A further object of the present disclosure may be to provide a cooking top which may be easier to control and to adjust.

The general idea at the base of the present disclosure may be to provide the cooking top with a system adapted to modify the pan presence control, upon a command by the user. The modification provides to deactivate or to modify the control parameters of said automatic control.

These and other objects of the present disclosure may be achieved by means of a cooking top incorporating the features set out in the appended claims, which are an integral part of the present description.

BRIEF DESCRIPTION OF THE FIGURES

Further objects and advantages of the present disclosure may become more apparent from the following detailed description and from the annexed drawing, which is provided by way of a non-limiting example, wherein:

FIG. 1 is a top view of a cooking top according to the present disclosure.

DETAILED DESCRIPTION OF THE EMBODIMENTS

The aim of the present to provide the induction cooking top 1 to be used also in the presence of small pans which are not sensed by the safety system that prevents inductors from being activated when nothing is on the cooking top.

Particularly the pan presence control is carried out for each cooking area of the induction cooking top, in the case this latter is divided into multiple areas, for example four areas (FIG. 1). One pan comprising ferromagnetic material can be positioned on each area. Usually the areas can have a different size for differently sized pans.

It is known that in case of a too small size of the object on the induction cooking top, the system does not activate, for example in the presence of metallic cutlery on the top such to avoid the latter to be heated and to prevent the user from burning himself/herself when he/she touches it. Moreover the system does not activate also in the presence of nonmetallic objects.

Therefore the system does not activate in the presence of a pan having such a size to have a surface in contact with the induction cooking top smaller than a size threshold (for example 50 $cm^2$) and this can be an undesired operation, since in this case the user would like the system to operate and to activate. However the control has to be provided for safety purposes.

According to the present disclosure, a system is provided which may be adapted to modify the pan presence control, upon a command by the user, which may be activated when the user decides to place a small-sized pan on the induction cooking top.

Said modification can provide the control to be deactivated, or the control parameters to be modified, for example such to lower the pan presence detection threshold.

Thus it is possible to use a small-sized pan which otherwise would be useless.

According to a possible variant, the cooking top has an interface 2 of the "touch" type containing manual controls. Preferably on the interface 2 one or more dedicated push-buttons (A, B) are inserted, upon the activation thereof the pan presence control is modified. Preferred variants for safety purposes can provide a particular sequence of commands and/or activations of push-buttons A, B intended to by-pass the pan presence control.

Further variants can provide the activation of the system of the invention to determine the reduction in the maximum power output.

Further variants can provide a control of the maximum time of power output and the subsequent deactivation.

In the case the induction cooking top is divided into multiple areas upon each of them it being possible to position a pan, the system of the disclosure can be provided only for one area, for example the one with the smallest size and therefore with the lowest maximum power output.

In order to deactivate the pan presence control modification mode, for example at the end of cooking, besides the manual deactivation by the user, it is possible to provide the system to periodically request a repetition of the pan presence control modification mode, otherwise it deactivates said modification mode automatically after a predetermined time period.

It is apparent that many changes may be made to the present disclosure by those skilled in the art without departing from the protection scope thereof as stated in the appended claims.

From the description above, a person skilled in the art will be able to implement the object of the invention without introducing further constructional details.

The invention claimed is:

1. An induction cooking apparatus, comprising:

a cooktop;

an interface comprising at least one user input;

inductors configured on the cooktop;

at least one current sensor configured to monitor current supplied to the inductors; and an automatic control system in communication with the inductors, the at least one current sensor, and the at least one input, wherein the system is configured to:

monitor a power supplied to the inductors via the at least one current sensor, wherein the power is indicative of a size of a cooking pan;

detect a presence or an absence of the cooking pan on the cooktop based on the power supplied to the inductors and the corresponding size of the cooking pan;

in response to the absence of the cooking pan on said cooktop, suppress an activation of one of the inductors;

in response to an input received via the interface, modify a control parameter of the detection, wherein the modification of the control parameter changes the detection of the absence of the cooking pan based on the power supplied to the inductors; and withdraw the suppression and restore the activation of one of the inductors in response to the modification of the control parameter.

2. The apparatus according to claim 1, wherein said control system is configured to deactivate the control parameter, thereby bypassing the suppression of the activation of the one of the inductors based on the detection.

3. The apparatus according to claim 1, wherein said control system is configured to modify the control parameter by lowering a pan presence detection threshold in response to the input received by the interface.

4. The apparatus according to claim 1, wherein the at least one user input comprises one or more activation push-buttons.

5. The apparatus according to claim 1, wherein said control system is further configured to:

control a maximum time of induction power output from the inductors and a subsequent deactivation of the induction power output.

6. The apparatus according to claim 1, wherein said control system is further configured to:

periodically request a repetition of said input received via the interface and deactivate the modification of the control parameter of the detection in response to not receiving the repetition.

7. The apparatus according to claim 1, wherein the cooktop is divided into multiple areas, and the modification of the control parameter of the detection is only associated with one area of the multiple areas.

8. The apparatus according to claim 1, wherein said control system is further configured to decrease the pan presence detection threshold to a decreased pan presence threshold.

9. The apparatus according to claim 8, wherein said control system is further configured to compare the power supplied to the decreased pan presence threshold;

and wherein the withdrawal of the suppression is in response to the power supplied being greater than the decreased pan presence threshold thereby decreasing a pan size required to withdraw the suppression.

10. An induction cooking apparatus, comprising:

a cooktop;

an interface comprising a heating setting input and a presence control input;

inductors configured on the cooktop;

at least one current sensor configured to monitor current supplied to the inductors; and an automatic control system in communication with the inductors, the at least one current sensor, and the at least one input, wherein the system is configured to:

activate the inductors to supply a power to a cooking load;

monitor the power supplied to the inductors via the at least one current sensor;

detect a presence or an absence of the cooking load on said cooktop based on the power supplied to the inductors by comparing the cooking load to a load presence detection threshold;

in response to the absence of the cooking pan on said cooktop, suppress an activation of one of the inductors; and in response to the presence control input received via the interface:

modify a control parameter changing the load presence detection threshold of the detection to a decreased load presence detection threshold, the decreased load presence threshold corresponding to a decreased size of the cooking load;

compare the cooking load to the decreased load presence threshold; and in response tothe cooking load being greater than the decreased load presence detection threshold, withdraw the suppression and restore the activation of the one of the inductors.

* * * * *